US006517698B1

(12) United States Patent
Johnson et al.

(10) Patent No.: US 6,517,698 B1
(45) Date of Patent: Feb. 11, 2003

(54) SYSTEM AND METHOD FOR PROVIDING ROTATION TO PLATING FLOW

(75) Inventors: Timothy L. Johnson, Tempe, AZ (US); Douglas G. Mitchell, Tempe, AZ (US); Jaynal Abedin Molla, Gilbert, AZ (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/680,871

(22) Filed: Oct. 6, 2000

(51) Int. Cl.[7] ..... C25D 5/20; C25D 7/00; C25D 11/32

(52) U.S. Cl. ..... 205/148; 205/149; 205/157

(58) Field of Search ..... 205/149, 157, 205/148

(56) References Cited

U.S. PATENT DOCUMENTS 4,304,641 A * 12/1981 Grandia et al. ..... 204/23
6,103,085 A * 8/2000 Woo et al. ..... 205/143
6,254,742 B1 * 7/2001 Hanson et al. ..... 204/279

FOREIGN PATENT DOCUMENTS

JP 62-133097 A * 6/1987

* cited by examiner

*Primary Examiner*—Edna Wong
(74) *Attorney, Agent, or Firm*—James L. Clingan, Jr.

(57) ABSTRACT

A system for electroplating integrated circuit wafers includes an electroplating solution containment chamber having a first end that is capable of supporting an integrated circuit wafer so that a surface of the wafer faces an internal volume of the chamber, and a second end opposing the first end across the internal volume. The system further includes a liquid directing element at the second end. The liquid directing element includes a plurality of channels having divergent axes so as to direct a helical flow of electroplating solution toward the surface of the integrated circuit wafer when the wafer is present and the liquid directing element is attached to a source of pressurized electroplating solution.

5 Claims, 3 Drawing Sheets

-PRIOR ART-

SYSTEM AND METHOD FOR PROVIDING ROTATION TO PLATING FLOW

FIELD OF THE INVENTION

The present invention relates generally to electroplating, and in particular relates to the electroplating of integrated circuit wafers.

BACKGROUND OF THE INVENTION

Electroplating is a common technique for applying metal to a surface, and is often employed in the construction of integrated circuits on silicon wafers. One circumstance in which electroplating is particularly important is in the manufacture of integrated circuits that are to be employed in flip-chip assembly or direct chip attach (DCA). In contrast to the manufacture of standard integrated circuits, where integrated circuit chips are coupled to lead frames by way of wire bonding and then encased within encapsulate, integrated circuits to be used in DCA have leads formed by protrusions placed directly atop the integrated circuits themselves. These integrated circuits are then implemented in circuit boards by connecting the top surfaces of the integrated circuits directly to the circuit boards, where the electrical connections between the integrated circuits and the circuit boards are formed by the protrusions.

The formation of such protrusions atop DCA integrated circuits typically requires two steps of electroplating. First, the integrated circuits are electroplated with copper atop the silicon die containing the integrated circuits. Second, the integrated circuits are electroplated with solder atop the copper. During attachment of the DCA integrated circuits to circuit boards or substrates, the solder is heated and then cooled such that the solder melts and then resolidifies to electrically couple the integrated circuits to the circuit boards or substrates. To guarantee proper connection of the DCA integrated circuits to the circuit boards, the various electroplated protrusions must be formed to have equal heights to within a few microns. If the protrusions are too short, bad connections can result between the DCA integrated circuits and the circuit boards due to a lack of connective material. If the protrusions are too tall, the protrusions may include excessive amounts of solder which can result in the creation of unwanted short circuits.

Although the manufacture of DCA integrated circuits is one significant example of the importance of electroplating, electroplating is also important in a variety of other circumstances, including the creation of interconnecting copper wiring within integrated circuits. Additionally, electroplating of a variety of other metals aside from copper and solder is commonly performed, including electroplating of gold, silver and tin. Further, electroplating is employed in a variety of manufacturing and other circumstances besides the electroplating of integrated circuit wafers.

Referring to FIG. 1, conventional electroplating of an integrated circuit wafer 10, such as a wafer for DCA integrated circuits, is performed by placing the wafer at a first end 14 of an electroplating chamber 12 having a cavity 16. The integrated circuit wafer 10 is positioned with the top of the wafer facing the inside of the cavity 16. In the embodiment shown, the electroplating chamber 12 supports the wafer with several fingers (not shown) that are spaced around the first end 14. In other embodiments, the wafer is supported proximate to the first end 14 of the electroplating chamber 12 by a supporting device (not shown).

The electroplating chamber 12 includes a single channel 20 at a second end 18 of the electroplating chamber, and is filled with liquid. During electroplating of the integrated circuit wafer 10 with a particular metal (e.g., copper or solder), a jet of liquid solution such as sulfuric acid, in which the metal is dissolved, is sprayed through the channel 20 toward the integrated circuit wafer 10. For a typical integrated circuit wafer 10 having a diameter of 8 inches, the jet of liquid solution may have a diameter of 1.3 inches at the channel 20 and diverge to a diameter of about 3 inches by the time it reaches the integrated circuit wafer. Inside chamber 12 is an anode 21.

A voltage differential (e.g., 3 Volts) is applied between the integrated circuit wafer 10, which is a cathode, through the liquid solution from the anode 21, such that a portion of the metal dissolved within the solution is reduced onto the cathode (in this case, the wafer). Upon striking the integrated circuit wafer 10, the jet of liquid solution radiates outward towards the outer edges of the integrated circuit wafer. Additional amounts of the metal come out of solution and adhere to the integrated circuit wafer 10 as the liquid solution travels along the surface of the wafer toward the outer edges of the wafer.

The solution then escapes the electroplating chamber 12 by flowing between the fingers (not shown) that are supporting the wafer, or in alternate embodiments where a separate supporting device is employed to support the wafer, between the wafer and a lip of the first end 14 of the electroplating chamber. The flow rate of the liquid solution during electroplating of the integrated circuit wafer 10 typically approaches 5–6 gallons per minute. The shape of the electroplating chamber 12 is typically cylindrical to minimize turbulence of the liquid within the electroplating chamber, and matches the shape of the integrated circuit wafer 10, which is typically circular.

While this conventional system for electroplating integrated circuit wafers results in metal being deposited on the integrated circuit wafers, the system has a significant drawback in that it produces electroplating that is uneven across the wafers. As shown in FIG. 2, a typical distribution of electroplated metal across an integrated circuit wafer can vary from 1.6 microns of deposited metal near the center of the wafer to only about 1 micron of deposited metal near the edges of the wafer. Such an uneven distribution of electroplated metal is undesirable. As discussed, in the particular case of DCA integrated circuits, for example, uneven plating results in protrusions that are of uneven height, which in turn increases the difficulty of attaching and electrically coupling the DCA integrated circuits to circuit boards.

In order to provide a more even distribution of metal than is provided by this conventional electroplating system, certain modifications to the conventional electroplating system have been implemented. In one such modified electroplating system, the integrated circuit wafer is mechanically rotated relative to the electroplating chamber so that the liquid solution sprayed towards the wafer, upon reaching the wafer, spirals with reference to the wafer as it radiates outward to the edges of the electroplating chamber. That is, while the liquid solution radiates outward from the center of the wafer along straight paths, the liquid solution appears to spiral outward with respect to the integrated circuit wafer because the wafer is rotating. A second modified electroplating system mechanically rotates a nozzle (e.g., in place of the channel 20) from which the jet of liquid solution emanates and thereby produces a rotating jet of liquid solution, such that the liquid solution similarly spirals outward relative to the integrated circuit wafer upon reaching the wafer.

These modified systems have the benefit that, because the wafer and the liquid solution are rotating relative to one another, the liquid solution flows across a longer path along the surface of the wafer as the liquid radiates to the outer edges of the wafer. Consequently, greater amounts of metal are deposited along the outer portions of the wafer than is the case with the electroplating system having a stationary wafer and simple channel (instead of a jet nozzle), and so the overall variation in the amount of metal deposited at different points on the wafer is decreased. Further, because of the greater contact between the liquid solution and the integrated circuit wafer, bubbles are less likely to be produced in the electroplated material deposited on the wafer.

Although these modified electroplating systems respectively having a rotating wafer and a rotating jet nozzle provide more even distributions of metal on the surfaces of wafers than the system of FIG. 1, the distributions of metal provided by these electroplating systems often still are significantly uneven. Further, these systems are disadvantageous in that the rotation of the wafer or jet nozzle requires the implementation and control of a motor to mechanically rotate the wafer or jet nozzle, respectively. Additionally, these systems can require electroplating chambers having more complex designs in order to facilitate the rotational operation of the system. These systems consequently are more costly to build and operate and require a greater amount of servicing to keep the systems operational than the system having a stationary wafer and simple channel (instead of a jet nozzle).

Consequently, there remains a need for an electroplating system that provides highly even distributions of metal, without bubbles, on integrated circuit wafers such as wafers for implementation in DCA integrated circuits, as well as on other surfaces for other applications. There further remains a need for an electroplating system that provides such even distributions and yet is less costly to build, operate and maintain than existing electroplating systems.

SUMMARY OF THE INVENTION

The present inventors have recognized that, instead of mechanically rotating an integrated circuit wafer or a single jet nozzle to produce spiraling motion of the liquid solution with respect to the wafer when the liquid solution reaches the wafer, multiple jets of liquid solution can be directed at a plurality of angles relative to the wafer in order to produce the spiraling motion. Specifically, the single channel (or jet nozzle) of the conventional electroplating systems from which the liquid solution emanates can be replaced with the combination of a first central channel that is a cylindrical cavity, and a plurality (e.g., eight) additional channels that are also cylindrical cavities and are spaced around the central channel along an intermediate circle that is concentric to the central channel.

The central channel has a central axis that is perpendicular to the surface of the integrated circuit wafer, and directs its jet of liquid solution directly toward the wafer. The plurality of additional channels have central axes that are oblique to the surface of the integrated circuit wafer. Each central axis of each respective additional channel is within a respective plane that is both perpendicular to the surface of the wafer and tangent to the intermediate circle (which is within a plane that is parallel to the surface of the wafer). Because of the oblique orientation of the additional channels, the jets of liquid solution that emanate from these channels are thus directed both perpendicular to (i.e., toward) the integrated circuit wafer and parallel to the surface of the wafer. Because of the variation in the orientations of these additional channels around the intermediate circle, the combination of these jets of liquid solution results in a helix of liquid solution traveling toward the integrated circuit wafer which, upon reaching the integrated circuit wafer, creates a spiral of liquid solution traveling across the surface of the wafer.

In particular, the present invention relates to a system for electroplating integrated circuit wafers. The system includes an electroplating solution containment chamber having a first end that is proximate to an integrated circuit wafer so that a surface of the wafer faces an internal volume of the chamber, and a second end opposing the first end across the internal volume. The system further includes a liquid directing element at the second end. The liquid directing element includes a plurality of channels having divergent axes so as to direct a helical flow of electroplating solution toward the surface of the integrated circuit wafer when the wafer is present and the liquid directing element is attached to a source of pressurized electroplating solution.

The present invention further relates to a device for directing the flow of liquid solution within an electroplating chamber. The device includes a first channel and a plurality of additional channels. The first channel includes a first central axis and each of the additional channels includes a respective central axis. Each of the central axes of the additional channels is located within a respective plane that is perpendicular and tangent to an intermediate curve surrounding the first central axis of the first channel, the intermediate curve being positioned within a plane that is perpendicular to the first central axis. The central axes of the additional channels are oblique in relation to the plane, so that when the liquid solution is pumped through the first central and additional channels, the liquid solution pumped through the first central channel flows out of the first central channel perpendicular to the plane, and the liquid solution pumped through the additional channels emanates in a helical manner away from the plane.

The present invention additionally relates to a system for electroplating a target element having at least one planar surface. The system includes an electroplating chamber having a cavity, a first end including a first opening and a second end including a second opening, wherein the first opening lies within a plane. The electroplating chamber is capable of receiving the target element at the first opening such that the planar surface of the target element is aligned with the plane. The system further includes a means for providing a helical stream of liquid solution within the electroplating chamber so that, upon receiving the target element and providing the helical stream of liquid solution, the liquid solution flows across the target element in a spiral manner.

The present invention further relates to a method of electroplating an integrated circuit wafer. The method includes providing an electroplating solution containment chamber having a first end and a second end opposing the first end across an internal volume, and providing a liquid directing element at the second end having a plurality of channels having divergent axes. The method additionally includes providing an integrated circuit wafer proximate to the first end so that a surface of the wafer faces the internal volume of the chamber. The method further includes coupling a source of pressurized electroplating solution to the liquid directing element, and directing a helical flow of electroplating solution out of the liquid directing element into the internal volume toward the surface of the integrated circuit wafer.

DETAILED DESCRIPTION OF THE PREFERRED EMBODIMENT

Figure 1:
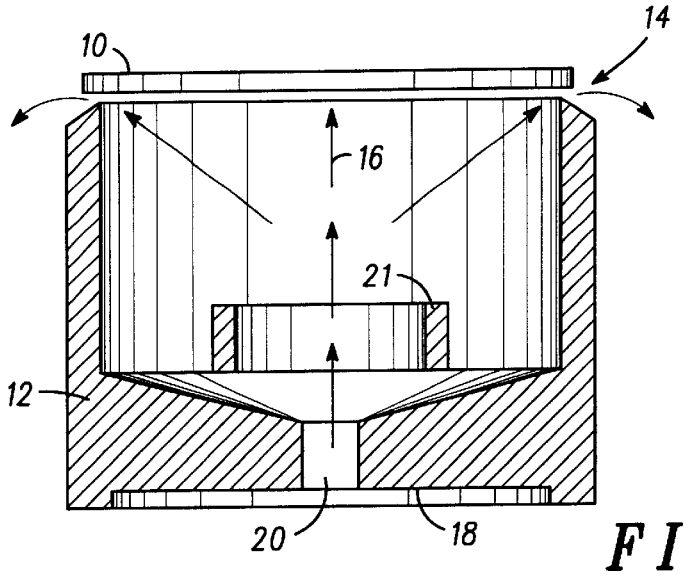
FIG. 1 is a cross-sectional view of a prior-art electroplating chamber being employed to electroplate an integrated circuit wafer.
Figure 2:
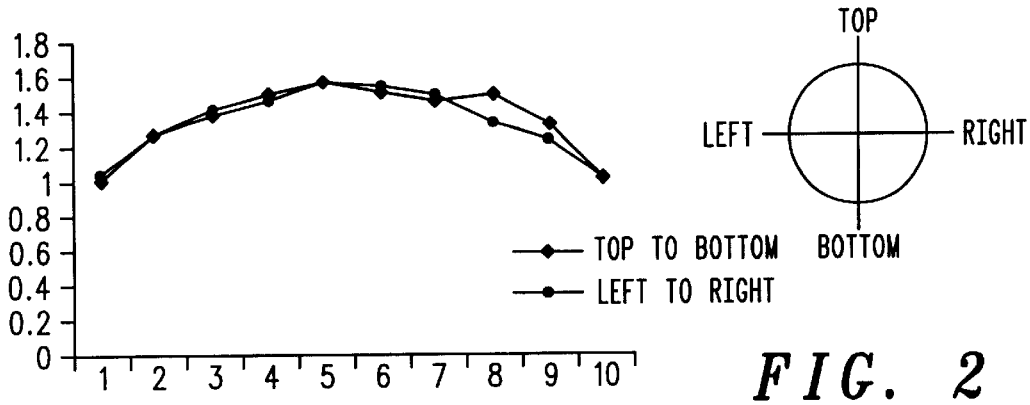
FIG. 2 is a graph showing typical variation in the thickness of metal electroplated on an integrated circuit wafer using the prior-art electroplating chamber of FIG. 1.
Figure 3:
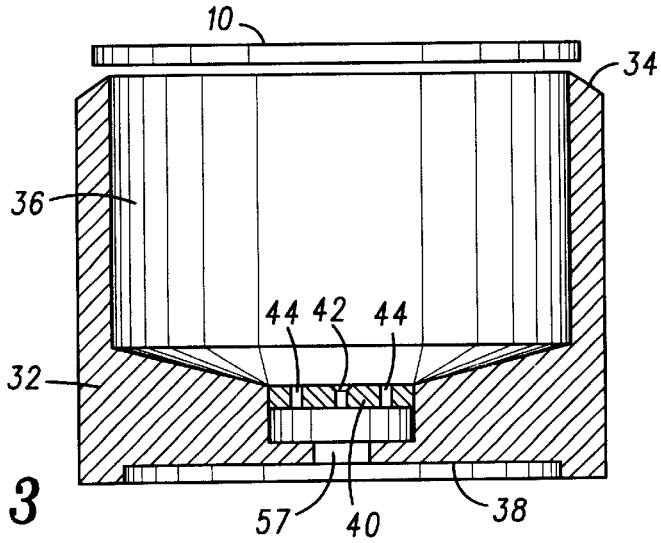
FIG. 3 is a cross-sectional view of an electroplating chamber in accordance with the present invention.

Referring to FIG. 3, a new system for electroplating includes an electroplating chamber 32 that is similar in structure to the electroplating chamber 12 of FIG. 1 except insofar as it includes a new plate 40 at a second end 38 of the electroplating chamber. The new plate 40 has a central channel 42 and a plurality of additional channels 44. As with the electroplating chamber 12, the electroplating chamber 32 includes a cavity 36 and first end 34 at which an integrated circuit wafer 10 is positioned in order to be electroplated. The liquid solution that flows against the integrated circuit wafer 10 can escape from the electroplating chamber 32 between fingers (not shown) that support the wafer, or in alternate embodiments where a separate supporting device is used to support the wafer, between the wafer and a lip of the first end 34 of the chamber. The new plate 40 fits in and seals off an opening 57 at the second end 38 of the electroplating chamber 32.

Figure 4:
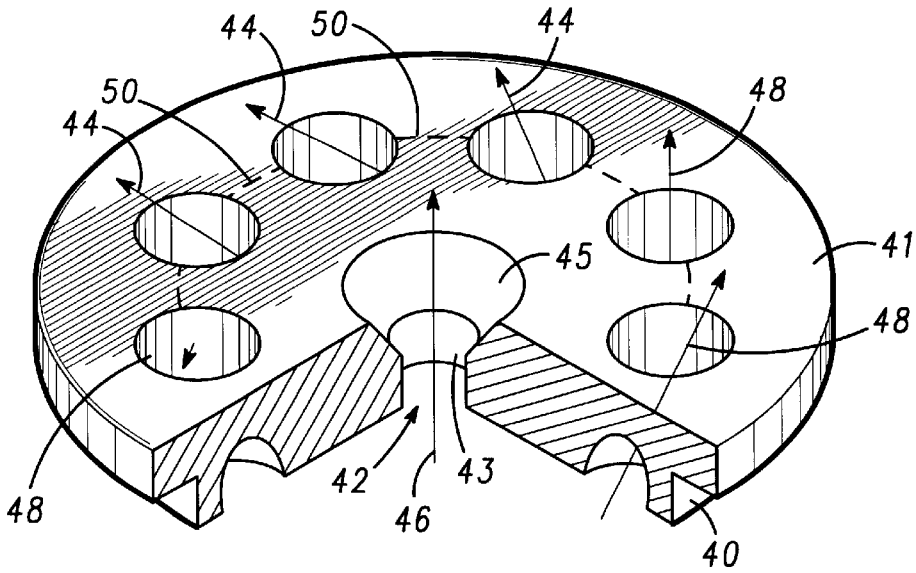
FIG. 4 is a perspective view of the plate of the FIG. 3 chamber.

Turning to FIG. 4, a perspective view of the new plate 40 including a cutaway portion shows the new plate in greater detail. As shown, the new plate 40 includes a central channel 42 and multiple additional channels 44 surrounding the central channel. In the preferred embodiment, eight additional channels 44 are spaced around the central channel 42, although in alternate embodiments the number of additional channels can be varied. Also in the preferred embodiment, the distances between each pair of neighboring additional channels are the same, although in alternate embodiments this need not be the case. As shown, the central channel 42 is located at the center of the plate 40, which is circular, and is approximately cylindrical with the central axis of the central channel being at the center of the plate. In the preferred embodiment, a lower portion 43 of the central channel is cylindrical, while the diameter of the central channel in an upper portion 45 of the central channel expands in a conic manner as one proceeds towards a top side 41 of the plate 40. Upon implementation of the plate 40 in the electroplating chamber 32, the top side 41 faces the inside of the cavity 36. The central axis 46 of the central channel 42 is perpendicular to the plate 40, which in turn is parallel to the integrated circuit wafer 10 during electroplating. Thus, the central channel 42 points directly towards the center of the integrated circuit wafer 10 during electroplating.

With respect to the multiple additional channels 44, each of these channels is cylindrical and is positioned a given distance from the central axis 46. Specifically, each of the additional channels 44 has a corresponding central axis 48, and each of the central axes 48 is positioned within a respective plane (not shown) that is both parallel to the central axis 46 and tangent (and perpendicular) to an intermediate circle 50 centered about the central axis 46. In the preferred embodiment, each of the central axes 48 of the additional channels 44 forms a 45 degree angle with respect to a vertical, i.e., with respect to a line parallel to the central axis 46. In alternate embodiments, the central axes 48 need not all form the same angle with respect to the vertical.

In one embodiment of the invention, the diameter of the inside of the cavity 36 of the electroplating chamber 32 is approximately 12 inches. The thickness of the new plate 40 is ⅜ inch, the diameter of the plate is approximately 2 inches, and the diameter of the intermediate circle 50 is 1.8 inches. Each of the cylindrical channels 42, 44 (except for the upper portion 45 of the central channel) has a diameter of 5⁄16 inch. In alternate embodiments, these dimensions can be varied. For example, the diameter of the plate relative to the electroplating chamber can be varied depending on the type of integrated circuit wafer being electroplated or other device being electroplated.

Further, in alternate embodiments, the number of additional channels 44 can also be varied, or multiple rings of additional channels can be provided. However, too few channels can result in too much back pressure such that excessive force is required to pump the liquid solution into the electroplating chamber 32, while too many channels produces a situation in which there is not enough resistance to create turbulence and consequently the liquid solution does not come out at the proper angles from the additional channels 44. Additionally, in alternate embodiments, one or more of the additional channels are tapered or otherwise modified from a purely cylindrical shape. The exact shape of the central channel 42 can also be varied from the preferred embodiment shown in FIG. 4, and in certain embodiments no central channel is provided. In certain embodiments, a given plate 40 can be employed in several different electroplating chambers.

Figure 5:
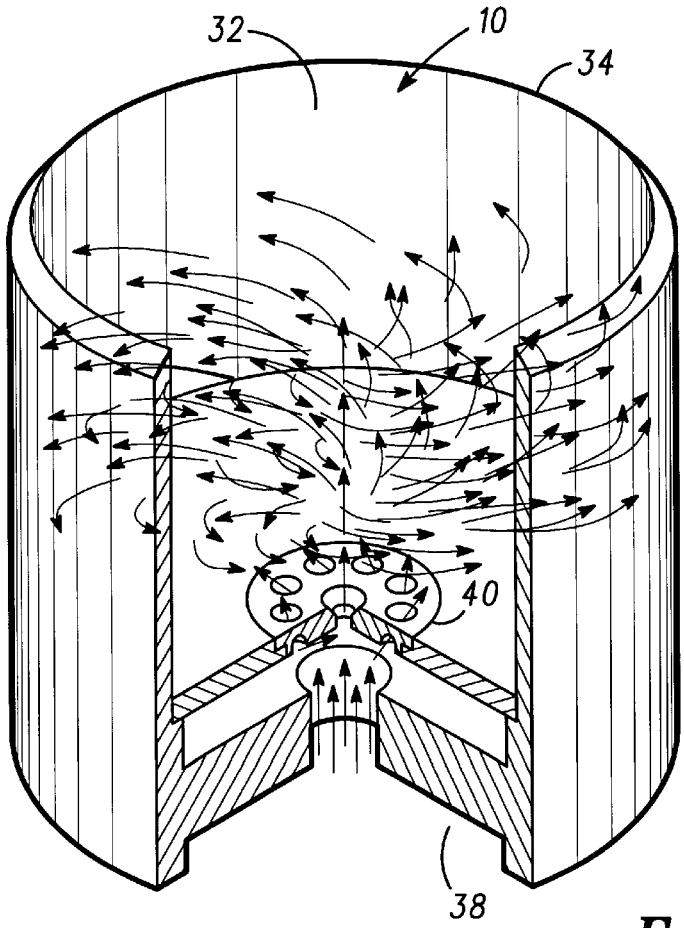
FIG. 5 is a perspective view of the electroplating chamber of FIG. 3 with a portion cutaway, which shows a helical flow of electroplating solution within the chamber during electroplating.

The new electroplating chamber 32 including the new plate 40 operates to provide improved electroplating because rotation is imparted to the liquid solution pumped through the multiple channels 42, 44 of the new plate. While the liquid solution entering the electroplating chamber 32 by way of the central channel 42 is directed straight up towards the center of the integrated circuit wafer 10 being electroplated, the liquid solution provided through each respective additional channel 44 flows toward the integrated circuit wafer at an angle that includes both a component directed towards the integrated circuit wafer and a component that is parallel to the surface of the integrated circuit wafer. The combined effect of the liquid solution flowing through all of the additional channels 44 together, each of which is directed in a different direction, is a rotating helix of liquid solution, as shown in FIG. 5.

Figure 6A:
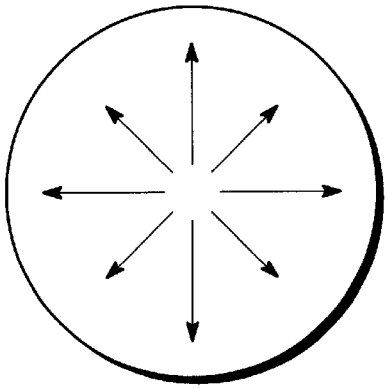
FIGS. 6A and 6B are two schematic diagrams showing, respectively, a prior art flow pattern and a flow pattern produced by the plate and electroplating chamber of FIGS. 3 and 4.
Figure 6B:
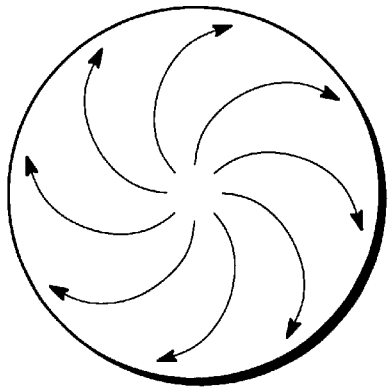

Because the liquid solution pumped through the plate 40 forms a rotating helix of liquid solution (FIG. 5), the liquid solution passes over the integrated circuit wafer 10 being electroplated in a spiral manner. That is, in contrast to a conventional electroplating system with a single central channel (as discussed with respect to FIG. 1), which produces a flow pattern over the integrated circuit wafer 10 which is completely radial (FIG. 6A), the new electroplating system with the new plate 40 causes the liquid solution to travel across the integrated circuit wafer 10 in a spiraling manner (FIG. 6B). Consequently, the liquid solution flows across a greater amount of the surface of the integrated circuit wafer 10 before reaching the edges of the integrated circuit wafer and exiting the chamber 32 than in the conventional system of FIG. 1. Further, no mechanical rotation of either the integrated circuit wafer 10 or a jet nozzle is necessary to produce this rotation of the flow of liquid solution for the electroplating.

Figure 7:
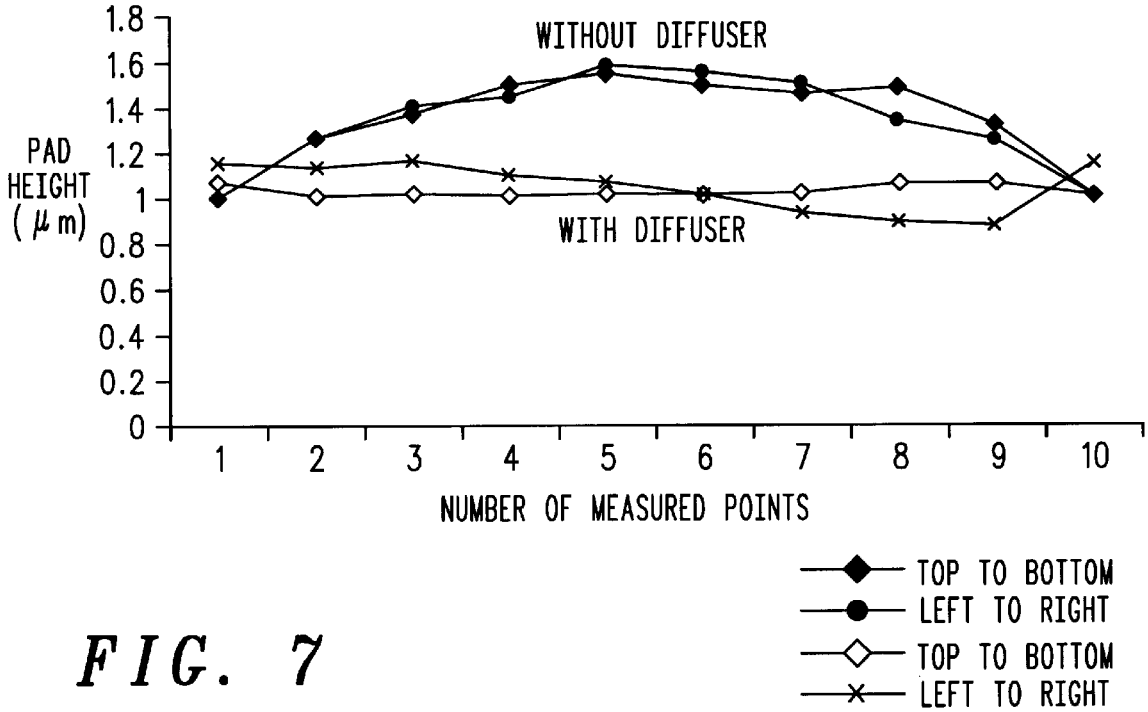
FIG. 7 is a graph showing typical variation in the thickness of metal electroplated on an integrated circuit wafer using the new plate and electroplating chamber of FIGS. 3 and 4, relative to the typical variation in the thickness of metal electroplated on the integrated circuit wafer using the prior-art electroplating chamber of FIG. 1.

Because the liquid solution for the electroplating flows over a greater amount of the surface of the integrated circuit wafer 10 (i.e., the liquid solution flows for a greater time over the integrated circuit wafer), the integrated circuit wafer experiences more uniform electroplating across its surface. Referring to FIG. 7, a graph is provided showing the variation in the thickness of silver electroplated on integrated circuit wafer using the new electroplating system with the new plate 40 in comparison with the conventional system of FIG. 1. As shown, the thickness of the metal that is electroplated using the new electroplating system (marked "with diffuser") is very highly uniform and is approximately 1 micron at all locations across the integrated circuit wafer, in contrast to the thickness of the metal electroplated using the conventional system of FIG. 1 (marked "without diffuser"). Additionally, in comparison with the conventional system of FIG. 1, electroplating takes place at a faster rate using the new plate 40.

While the foregoing specification illustrates and describes the preferred embodiments of this invention, it is to be understood that the invention is not limited to the precise construction herein disclosed. The invention can be embodied in other specific forms without departing from the spirit or essential attributes. Accordingly, reference should be made to the following claims, rather than to the foregoing specification, as indicating the scope of the invention.

What is claimed is:

1. A method of electroplating an integrated circuit wafer, the method comprising:

providing an electroplating solution containment chamber having a first end and a second end opposing the first end across an internal volume;

providing a liquid directing element at the second end having a plurality of channels having divergent axes;

providing the integrated circuit wafer proximate to the first end so that a surface of the wafer faces the internal volume of the chamber;

coupling a source of pressurized electroplating solution to the liquid directing element, wherein the electroplating solution comprises a metal; and directing a helical flow of electroplating solution out of the liquid directing element into the internal volume toward the surface of the integrated circuit wafer thereby depositing the metal on the integrated circuit wafer by electroplating.

2. The method of claim 1, wherein the liquid directing element further comprises a central channel that is cylindrical and has a first central axis, wherein each of the plurality of channels hag a respective central axis, each of the plurality of channels is positioned along an intermediate circle that is concentric around the first central axis and is within a first plane, and the respective central axis of each of the plurality of channels is positioned within a respective plane that is perpendicular and tangent to the intermediate circle, and wherein the first central axis is perpendicular to the first plane and each of the respective central axes of each of the plurality of channels is at a respective oblique angle relative to the first plane.

3. The method of claim 2, wherein the helical flow of electroplating solution includes a component emanating from the central channel that emanates perpendicular to the first plane, and further includes a component emanating helically from the plurality of channels.

4. The method of claim 1, further comprising:

electroplating the integrated circuit wafer with metal from the electroplating solution as the electroplating solution passes over the integrated circuit wafer in a spiral manner.

5. The method of claim 1, further comprising:

applying a voltage differential between the integrated circuit wafer, which is a cathode, and an anode through which the pressurized electroplating solution flows so that the metal from the electroplating solution adheres to the integrated circuit wafer as the electroplating solution passes over the integrated circuit wafer.

* * * * *